United States Patent [19]

Cohen

[11] Patent Number: 5,045,116

[45] Date of Patent: Sep. 3, 1991

[54] PRE-MOISTENED TOWELETTE FOR, AND METHOD OF, CLEANING COMPACT DISCS

[76] Inventor: Eric Cohen, Jockey Club, 11111 Biscayne Blvd., Apt. 615, Miami, Fla. 33161

[21] Appl. No.: 353,535

[22] Filed: May 18, 1989

[51] Int. Cl.[5] ..... B08B 7/00

[52] U.S. Cl. ..... 134/6; 134/7; 118/325; 15/97 R; 15/214; 15/229 R; 15/209 R; 15/104.93; 252/91; 428/248; 428/280; 428/288

[58] Field of Search ..... 134/6, 7; 118/325; 15/97 R, 214, 220 R, 209 R, 104.93; 252/91; 428/248, 280, 288

[56] References Cited

U.S. PATENT DOCUMENTS

| | | | |
|---|---|---|---|
| 2,999,265 | 9/1961 | Duane et al. | 15/104.93 |
| 4,666,621 | 5/1987 | Clark et al. | 15/214 |
| 4,772,501 | 9/1988 | Johnson et al. | 15/104.93 |

*Primary Examiner*—Theodore Morris
*Assistant Examiner*—Zeinab E. El-Arini
*Attorney, Agent, or Firm*—Kirschstein, Ottinger, Israel & Schiffmiller

[57] ABSTRACT

A pre-moistened towelette wipes a compact disc clean without leaving a visible residue thereon. An ultra-pure tissue, free of binders, fillers and dyes, is permeated with a liquid cleaning preparation comprised of a highly concentrated solution of ultra-pure alcohol, a non-ionic, ultra-pure surfactant, and ultra-pure water.

19 Claims, No Drawings

PRE-MOISTENED TOWELETTE FOR, AND METHOD OF, CLEANING COMPACT DISCS

BACKGROUND OF THE INVENTION

1. Field of the Invention

This invention generally relates to a premoistened towelette for, and a method of, cleaning compact discs and, more particularly, for wiping compact discs clean without leaving a visible residue thereon.

2. Description of Related Art

Optical components such as glass or plastic lenses are typically cleaned by high-grade paper to avoid scratching the lenses with paper that is too coarse. Also, the cleaning paper is typically dry to avoid smearing the lenses with a liquid cleaning solution which, after evaporation and drying, leaves a visible residue on the lenses. Moistened towelettes are therefore not employed in optical applications and are conventionally relegated to those applications where a certain amount of residue is acceptable or at least tolerated, for example, where one wishes to clean his or her face and hands.

Compact discs are optical components in the sense that the information recorded thereon is read by an optical reader. Such compact discs, just as their older cousin, the vinyl phonograph record, collect dust and need to be cleaned from time to time. Heretofore, compact discs have been cleaned by a variety of methods, all deficient in one or more respects. When dry paper or cloth is used to clean a compact disc, scratches may be formed in the plastic coating overlying the discs. Dry cleaning paper is not altogether effective in removing skin oils of fingerprints generated during handling of the discs. Cleaning paper moistened with water, however, although slightly more effective than dry paper in removing or at least spreading out skin oils, leaves a liquid film which does not dry uniformly and leaves a telltale residue behind. The residue is often visible to the naked eye. Aside from the sloppy appearance of dirty compact discs, which would be anathema to a true audiophile, dirt, dust and other contaminants can, in certain cases, actually interfere with the proper reading of the compact discs, and compromise the overall high quality of audio/visual information promised by compact discs.

SUMMARY OF THE INVENTION

1. Objects of the Invention

It is a general object of this invention to provide a moistened towelette for, and a method of, wiping a compact disc clean without leaving a visible residue thereon.

It is another object of this invention to reliably clean a compact disc without scratching the same.

Another object of this invention is to rapidly, efficiently and inexpensively clean a compact disc.

2. Features of the Invention

In keeping with these objects, and others which will become apparent hereinafter, one feature of this invention resides, briefly stated, in a moistened towelette for, and a method of, wiping a compact disc clean without leaving a visible reside on the compact disc. This invention comprises an ultra-pure, porous tissue composed essentially of hemp and cellulose fibers. The tissue is free of binders which are conventionally used in the paper industry to keep the cellulose fibers together. The tissue is also free of fillers, which are also conventionally used in the trade in order to impart a specific opaqueness, thickness or hand to the tissue. The tissue is also free of dyes, which are conventionally used to color the paper to a desired hue. The cellulose fibers may be derived from any hardwood, softwood, sugar cane, grass, straw or other cellulose source. The hemp, in the preferred embodiment, comes from the Philippines.. The tissue is devoid of chemicals, minerals, resins, waxes, polymers, pigments, fillers, gums, sizing agents, silicones, optical brighteners, waterproofing compounds, anti-static compounds, plasticizers, or other additives common to the paper industry. The resultant tissue is of a very high grade.

The tissue is permeated by a liquid cleaning preparation. The preparation includes a highly concentrated solution of ultra-pure alcohol whose concentration is at least 99% by weight of the solution; a nonionic ultra-pure surfactant; and ultra-pure water. The alcohol solution may be in the range from about 40% to about 80% by weight of the preparation; the surfactant may be in the range from about 0.005% to about 0.2% by weight of the preparation; and the water makes up the balance by weight of the preparation.

In the preferred formulation, the alcohol is isopropyl alcohol constituting about 70% by weight of the preparation; the surfactant is polysorbate 20 (Tween 20) or polysorbate 80 (Tween 80) constituting about 0.03% by weight of the preparation; and the water is steam distilled and constitutes 29.97% by weight of the preparation.

The ultra-pure alcohol and the ultra-pure water each have an evaporative residue level which is less than 2 parts per million (2 micrograms per gram). The alcohol solution has a concentration of 99.9996%. The water has a resistivity of more than 1 million ohms.

In the preferred formulation, the isopropyl alcohol constitutes 0.688% by liquid volume of the preparation; the water constitutes 0.312% by liquid volume of the preparation; and the Tween 20 or Tween 80 constitutes 0.0025036 lb. by weight (the surfactant being a powder).

In further accordance with this invention, the preparation-permeated tissue has a wet tensile strength of at least 400 grams per 25 mm in order to withstand tearing when the preparation-permeated tissue is wiped across a compact disc surface to be cleaned.

Since the tissue is composed essentially of hemp and cellulose fibers and is free of the aforesaid binders, fillers, dyes and other additives mentioned above, the liquid cleaning preparation is non-reactive with the tissue, as well as the compact disc surface itself. When the preparation evaporates from the compact disc surface at room temperature, a visually-undetectable residue is obtained.

The alcohol need not be isopropyl alcohol, but can equally well be ethanol, n-propanol or i-propanol.

In the preferred embodiment, the hemp and cellulose fibers are interwoven, thereby avoiding the need for binders to keep the fibers together during use.

The tissue is preferably permeated with the preparation in advance, and sealed in an openable packet lined with a plastic or metallic lining to prevent evaporation of the preparation from the packet. Prior to use, one tears open the packet, exposing the preparation-permeated tissue which is now available for use in wiping the compact disc clean.

The novel features which are considered as characteristic of the invention are set forth in particular in the appended claims. The invention itself, however, both as to its construction and its method of operation, together with additional objects and advantages thereof, best will be understood from the following description of specific embodiments.

DETAILED DESCRIPTION OF THE PREFERRED EMBODIMENTS

A compact disc is wiped clean without leaving a visible residue thereon by using a moistened towelette which comprises a tissue and a liquid cleaning preparation permeating the tissue. The tissue is a high-strength, lightweight, ultra-pure, porous tissue composed essentially of hemp and cellulose fibers preferably interwoven. The cellulose fibers may be derived from any conventional cellulose source, e.g. hardwoods, softwoods, sugar cane, grass and straw. The use of binders, fillers, dyes and other additives common to the paper industry is specifically avoided. For example, dyes and pigments such as titanium dioxide, calckum carbonate, alumina, barium sulfate, china clay, potassium titanate, diatomite, silica, talc, zinc oxide, zinc stearate, etc., are not permitted. Fillers such as aluminum diresinate, aluminum abietate, etc., are also not permitted. Gums such as starch, dextrin, pectins, alginates, gelatins, animal glues, carrageenan, agars, guar, tragacanth, etc., are also not permitted. Sizing agents such as alkyds, phenols, lignins, rubber polymers, wood rosin, resins, resinates, resinic acid, asphalts, fatty acid soaps, acrylic acid ester copolymers, waxes, urea, latex, polyvinyl alcohol, alkyl ketene dimers, uronic acids, stearato chromic chloride, glyoxal, glycerine, propylene glycol, polyvinylpyrollidine, malamine resins, polyacrylamides, ethylene oxide polymers, vinyl monomers, maleic anhydride, etc., are also not used. Silicones, optical brighteners, waterproofing compounds, anti-static compounds, plasticizers and, in short, other additives used in the production of paper, are omitted from the ultra-pure, porous tissue of this invention.

The cellulose fibers may, in certain cases, be partially jelled if all traces of chemicals are extracted. The fibers may be parchmented if the acids are extracted. However, total extractables must not be more than 1 microgram per gram of paper.

In the preferred embodiment, the tissue has a weight of about 21.5 g/m$^2$, an air permeability of 350 L/min/100 cm$^2$ at 12.7 mm $H_2O$ $\Delta P$, and a tensile strength as measured in g/25 mm of 5000 (dry MD), 1620 (dry CD) and 435 (wet CD). The tissue has a pH of about 5.2,and a bursting strength when dry of 85 kPa. Philippine hemp is preferred. A tissue meeting the above specifications is available from the C. H. Dexter Co. of Windsor Locks, Conn., as Model No. Grade 17V.

The cleaning preparation includes a highly concentrated solution of ultra-pure alcohol. The alcohol acts as a solvent. The solvent may be isopropyl alcohol, ethanol, n-propanol or i-propanol. The concentration of the alcohol must be at least 99% by weight of the solution and, in the preferred case, is 99.9996%. The solution lies in the range from about 40% to about 80% by weight of the preparation.

The preparation further includes a non-ionic ultra-pure surfactant operative for spreading out the solvent so that the solvent does not dry in one spot, and also for emulsifying the skin oils of fingerprints on the compact disc to be cleaned. Polysorbate 20 or 80 (Tween 20 or 80) are representative of suitable surfactants which may be used in the range from about 0.005% to about 0.2% by weight of the preparation.

The preparation further includes ultra-pure water making up the balance by weight of the preparation. The water is preferably steam distilled and has a resistivity of more than 1 million ohms.

In the preferred embodiment, isoproply alcohol is used as the solvent, and comprises 0.688% by liquid volume of the preparation; the ultra-pure water represents 0.312% by liquid volume of the preparation; and the Tween 20 or 80, in powdered form, constitutes 0.0025036 lb. by weight of the preparation. The isopropyl alcohol is 70% by weight of the preparation; the water is 29.97% by weight of the preparation; and the Tween 20 or 80 is 0.03% by weight of the preparation.

The ultra-pure alcohol and ultra-pure water each have an evaporative residue level which is less than 2 parts per million.

In use, the preparation-permeated tissue is wiped across a compact disc surface to be cleaned. Due to the aforementioned high wet tensile strength of the tissue, tearing of the tissue is prevented during use. Since the tissue is free of binders, fillers, dyes and the aforementioned additives, there is nothing with which the preparation and, more particularly, the highly concentrated alcohol solution, can react. Hence, after wiping has occurred, a liquid film is deposited over the compact disc surface and, once the film evaporates, there is no visually-detectable residue.

The tissue is permeated by the preparation in advance, and packed into sealed packets having inner linings made of plastic or metal designed to prevent evaporation of the preparation through the walls of the packet. The packet is normally sealed closed, and is opened by a user by tearing across a marginal edge of the packet just prior to use. One such pre-moistened towelette can be used to wipe at least one, if not a plurality of, compact discs clean. A plurality of such towelettes, each in its own individual packet, may be packed in a larger dispenser box.

It will be understood that each of the elements described above, or two or more together, also may find a useful application in other types of constructions differing from the types described above.

While the invention has been described as embodied in a pre-moistened towelette for, and method of, cleaning compact discs, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

1. A moistened towelette for wiping a compact disc clean without leaving a visible residue on the compact disc, consisting essentially of:

(A) an ultra-pure, porous tissue composed essentially of hemp and cellulose fibers and being free of binders, fillers and dyes;

(B) a liquid cleaning preparation permeating the tissue, and including
(i) a highly concentrated solution of ultra-pure alcohol whose concentration is at least 99% by weight of the solution, said solution being in the range from about 40% to about 80% by weight of the preparation,
(ii) a non-ionic, ultra-pure surfactant in the range from about 0.005% to about 0.2% by weight of the preparation,
(iii) ultra-pure water making up the balance by weight of the preparation, and
(iv) said ultra-pure alcohol and ultra-pure water each having an evaporative residue level which is less than 2 parts per million;
(C) said preparation-permeated tissue having a wet tensile strength of at least 400 grams per 25 mm to withstand tearing when the preparation-permeated tissue is wiped across a compact disc surface to be cleaned; and
(D) said preparation being non-reactive with the tissue and the compact disc surface, and evaporating from the compact disc surface with a visually-undetectable residue thereon after wiping has occurred.

2. The towelette as recited in claim 1, wherein the tissue has a weight of at least 20 g/m$^2$.

3. The towelette as recited in claim 1, wherein the hemp and cellulose fibers are interwoven.

4. The towelette as recited in claim 1, wherein the alcohol is a solvent selected from the group consisting of isopropyl alcohol, ethanol, n-propanol or i-propanol.

5. The towelette as recited in claim 1, wherein the alcohol is isopropyl alcohol whose concentration is on the order of 99.9996% by weight of the solution.

6. The towelette as recited in claim 1, wherein the surfactant is selected from the group consisting of polysorbate 20 or 80.

7. The towelette as recited in claim 1, wherein the water is steam distilled and has a resistivity of at least 1 million ohms.

8. The towelette as recited in claim 1, wherein the solution is about 70% by weight of the preparation, wherein the surfactant is about 0.03% by weight of the preparation, and wherein the water is about 29.97% by weight of the preparation.

9. The towelette as recited in claim 1; and further comprising an openable packet in which the preparation-permeated tissue is contained prior to opening the packet.

10. A method of cleaning a compact disc without leaving a visible residue on the compact disc, consisting essentially of the steps of:
(A) composing an ultra-pure, porous tissue essentially of hemp and cellulose fibers and free of binders, fillers and dyes;
(B) permeating the tissue with a liquid cleaning preparation that includes
(i) a highly concentrated solution of ultra-pure alcohol whose concentration is at least 99% by weight of the solution, said solution being in the range from about 40% to about 80% by weight of the preparation,
(ii) a non-ionic, ultra-pure surfactant in the range from about 0.005% to about 0.2% by weight of the preparation,
(iii) ultra-pure water making up the balance by weight of the preparation, and
(iv) said ultra-pure alcohol and ultra-pure water each having an evaporative residue level at room temperature which is less than 2 parts per million;
(C) wiping the preparation-permeated tissue across a compact disc surface to be cleaned, said preparation-permeated tissue having a wet tensile strength of at least 400 grams per 25 mm to withstand tearing during the wiping step; and
(D) said preparation being non-reactive with the tissue and the compact disc surface, and evaporating from the compact disc surface with a visually-undetectable residue thereon after the wiping step has occurred.

11. The method as recited in claim 10, wherein the composing step is performed by composing the tissue with a weight of at least 20 g/m$^2$.

12. The method as recited in claim 10, wherein the composing step is performed by interweaving the hemp and cellulose fibers.

13. The method as recited in claim 10, wherein the alcohol is a solvent selected from the group consisting of isopropyl alcohol, ethanol, n-propanol or i-propanol.

14. The method as recited in claim 10, wherein the alcohol is isopropyl alcohol whose concentration is on the order of 99.9996% by weight of the solution.

15. The method as recited in claim 10, wherein the surfactant is selected from the group consisting of polysorbate 20 or 80.

16. The method as recited in claim 10, wherein the water is steam distilled and has a resistivity of at least 1 million ohms.

17. The method as recited in claim 10, wherein the solution is about 70% by weight of the preparation, wherein the surfactant is about 0.03% by weight of the preparation, and wherein the water is about 29.97% by weight of the preparation.

18. The method as recited in claim 10; and further comprising the steps of packing the preparation-permeated tissue in an openable packet, and opening the packet prior to the wiping step.

19. A moistened towelette for wiping a compact disc clean without leaving a visible residue on the compact disc, consisting essentially of:
(A) an ultra-pure, porous tissue composed essentially of interwoven hemp and cellulose fibers and being free of binders, fillers and dyes;
(B) a liquid cleaning preparation permeating the tissue, and including
(i) a highly concentrated solution of ultra-pure alcohol whose concentration is at least 99% by weight of the solution, said solution being about 70% by weight of the preparation, said alcohol being a solvent selected from the group consisting of isopropyl alcohol, ethanol, n-propanol or i-propanol,
(ii) a non-ionic, ultra-pure surfactant being about 0.03% by weight of the preparation, said surfactant being selected from the group consisting of polysorbate 20 or 80,
(iii) ultra-pure distilled water making up the balance of about 29.97% by weight of the preparation, and
(iv) said ultra-pure alcohol and ultra-pure water each having an evaporative residue level which is less than 2 parts per million;
(C) said preparation-permeated tissue having a wet tensile strength of at least 400 grams per 25 mm to withstand tearing when the preparation-permeated tissue is wiped across a compact disc surface to be cleaned; and (D) said preparation being non-reactive with the tissue and the compact disc surface, and evaporating from the compact disc surface with a visually-undetectable residue thereon after wiping has occurred.

* * * * *